US006666333B2

(12) United States Patent
Auclair

(10) Patent No.: US 6,666,333 B2
(45) Date of Patent: Dec. 23, 2003

(54) CARTON AND CARTON BLANK

(75) Inventor: Jean-Michel Auclair, Chateauroux (FR)

(73) Assignee: MeadWestvaco Packaging Systems, LLC, Stamford, CT (US)

( * ) Notice: Subject to any disclaimer, the term of this patent is extended or adjusted under 35 U.S.C. 154(b) by 0 days.

(21) Appl. No.: 10/216,584

(22) Filed: Aug. 9, 2002

(65) Prior Publication Data

US 2003/0034269 A1 Feb. 20, 2003

Related U.S. Application Data

(63) Continuation of application No. PCT/US01/04427, filed on Feb. 9, 2001.

(51) Int. Cl.[7] ..... B65D 81/127

(52) U.S. Cl. ..... 206/521; 229/117

(58) Field of Search ..... 206/170, 174–176, 206/418, 521, 583, 591; 229/4.5, 5.5, 117, 117.01, 184

(56) References Cited

U.S. PATENT DOCUMENTS

| | | | | |
|---|---|---|---|---|
| 975,121 A | | 11/1910 | Carter | |
| 1,985,075 A | * | 12/1934 | Bird | 206/418 |
| 2,556,341 A | | 6/1951 | Ringler | |
| 2,611,529 A | | 9/1952 | Currivan | |
| 2,643,814 A | | 6/1953 | Bradley | |
| 2,692,077 A | | 10/1954 | Kuhlman | |
| 2,732,123 A | | 1/1956 | Bolding | |
| 2,827,221 A | | 3/1958 | Vines | |
| 2,949,219 A | | 8/1960 | Frankenstein | |
| 3,075,683 A | | 1/1963 | Grossman et al. | |
| 3,102,674 A | | 9/1963 | Hamilton | |
| 3,217,960 A | | 11/1965 | Davis | |
| 3,245,602 A | * | 4/1966 | Bovard | 206/521 |
| 3,661,319 A | | 5/1972 | Koehler | |
| 3,752,301 A | * | 8/1973 | Bluemel | 206/521 |
| 3,904,036 A | | 9/1975 | Forrer | |
| 4,114,796 A | | 9/1978 | Voges | |
| 4,266,716 A | | 5/1981 | Austin | |
| 4,272,008 A | | 6/1981 | Wozniacki | |
| 4,335,842 A | | 6/1982 | Bradford et al. | |
| 4,560,069 A | * | 12/1985 | Simon | 206/591 |
| 5,259,507 A | * | 11/1993 | Smith | 206/591 |
| D358,095 S | | 5/1995 | Weimer | |
| 5,419,471 A | * | 5/1995 | Polumbaum et al. | 206/174 |
| 5,730,289 A | | 3/1998 | Cappels | |
| 5,788,077 A | * | 8/1998 | Sisk | 206/521 |

FOREIGN PATENT DOCUMENTS

| | | |
|---|---|---|
| FR | 2170930 | 9/1973 |
| GB | 853891 | 11/1960 |
| WO | 97/29021 | 8/1997 |

* cited by examiner

*Primary Examiner*—Jim Foster
(74) *Attorney, Agent, or Firm*—Tsughiko Suzuki

(57) ABSTRACT

An receptacle and a blank for forming a receptacle carrier for packaging fragile articles includes a plurality of side wall panels hinged together to form a collapsible upright tubular structure for receiving an article and article support structure at the lower end of the tubular structure for supporting the article. The support structure has a plurality of displaceable strips secured together such that when the tubular structure is erected from a flat collapsed form, the displaceable strips are automatically displaced into the tubular structure to form the supporting structure.

15 Claims, 7 Drawing Sheets

CARTON AND CARTON BLANK

This is a continuation of international application No. PCT/US01/04427, filed Feb. 9, 2001, which is hereby incorporated by reference.

BACKGROUND OF THE INVENTION

The present invention relates to a carton and carton blank for forming the cartons. More particularly, the invention relates to a carton and blank for packaging fragile articles such as bottles of perfume for example It is known to provide a two part package comprising an inner cushion member and an outer carton, see for example U.S. Pat. No. 2,692,077 (KUHLMAN) or U.S. Pat. No. 4,114,796. However, in such cartons, the base, sides and tops of the article can be prone to damage when moved or stored.

SUMMARY OF THE INVENTION

The present invention and its preferred embodiments seek to overcome or at least mitigate the problems of the prior art One aspect of the invention provides a receptacle for packaging fragile articles comprising a plurality of side wall panels hinged together to form a collapsible upright tubular structure for receiving an article and an article support structure at the lower end of the tubular structure for supporting the article, wherein the support structure comprises a plurality of displaceable strips secured together such that when the tubular structure is erected from a flap collapsed form, the displaceable strips are automatically displaced into the tubular structure to form a supporting means. Preferably, at least one of the displaceable strips may be provided along its upper edge with a foldable flap for providing a platform for the article.

According to an optional feature of this aspect of the invention, there may comprise two pairs of mutually hinged side wall panels, each pair having a respective displaceable strip wherein the displaceable strips are partially connected.

In one embodiment, the displaceable strips may be partially connected along a common lower edge.

Alternatively, a portion of the displaceable strips may be in face contacting relationship and are secured thereto. Optionally, the support structure may further comprise a pair of glue flaps to secure part of the displaceable strips together.

A second aspect of the invention provides a cushion member for placement into an outer carton comprising a plurality of side wall panels hinged together to form a collapsible upright tubular structure for receiving an article, and stabilizing means hingedly connected to the tubular structure for frictional engagement with the inside surface of the outer carton. Preferably, the stabilizing means comprises a friction panel extending from the tubular structure to one of the side walls of the outer carton. More preferably, the stabilizing means comprises a second friction panel extending from the opposing part of the tubular structure to an opposing side wall of the outer carton.

A third aspect of the invention provides an article carrier comprising an outer carton and a cushion member, wherein the outer carton has four side walls and the cushion member has a diamond shaped cross section with its four sides disposed intermediate the adjacent side wall of the outer carton wherein the friction panels are hinged respectively to two diametrically opposed corners of the cushion member.

A fourth aspect of the invention provides an article carrier comprising a plurality of side wall panels hinged together to form a collapsible upright tubular structure for receiving an article and top protection means hinged to the tubular structure wherein the top protection means comprises a first and second top panels hinged respectively to two adjacent side wall panels and wherein there further comprises a gusset panel intermediate and hinged to the first and second top panels. Preferably, there further comprises a glue flap struck from the gusset panel and foldably connected to one of the top panels which glue flap is adapted to be placed in face contacting relationship with the other one of the top panels.

A fifth aspect of the invention provides a blank for forming an article carrier for holding fragile articles, which blank comprising a first series of panels and a second series of panels, each series including opposite end panels forming the stabilizing means and medial panels for forming a tubular structure wherein the first and second series are hinged together along a common lower edge of the end panels.

A sixth aspect of the invention provides a blank for forming a receptacle comprising two pairs of mutually hinged side wall panels to form a collapsible upright tubular structure for receiving an article and an article support structure at the lower end of the tubular structure for supporting the article, wherein each pair of side wall panels having a respective displaceable strip for forming a support structure. Optionally, at least one of the displaceable strips is provided along its upper edge with a foldable flap for providing a platform for the article in a set up condition.

According to an optional feature of the sixth aspect of the invention, the displaceable strips are partially connected along a common lower edge.

According to an optional feature of the sixth aspect of the invention, the support structure may further comprise a pair of glue flaps to secure part of the displaceable strips together in a set up carton.

According to a seventh aspect of the invention there is provided a blank for forming a cushion member for placement into an outer carton comprising a plurality of side wall panels hinged together to form a collapsible upright tubular structure for receiving an article, and stabilizing means comprising a pair of friction panels extending from the tubular structure to one of the side walls of the outer carton.

According to an eighth aspect of the invention, there is provided a blank for forming an article carrier comprising a plurality of side panels hinged together to form a collapsible upright tubular structure for receiving an article and top protection means hinged to the tubular structure wherein the top protection structure comprises a first and second top panels hinged respectively to two adjacent side wall panels and wherein there further comprises a gusset panel intermediate and hinged to the top panels. Optionally, there may further comprise a glue flap struck from the gusset panel and foldably connected to one of the top panels which glue flap is adapted to be placed in face contacting relationship with the other one of the top panels.

BRIEF DESCRIPTION OF THE DRAWINGS

Exemplary embodiments of the present invention will now be described, by way of example only, with reference to the accompanying drawings in which.

DETAILED DESCRIPTION OF THE PREFERRED EMBODIMENTS

Figure 1:
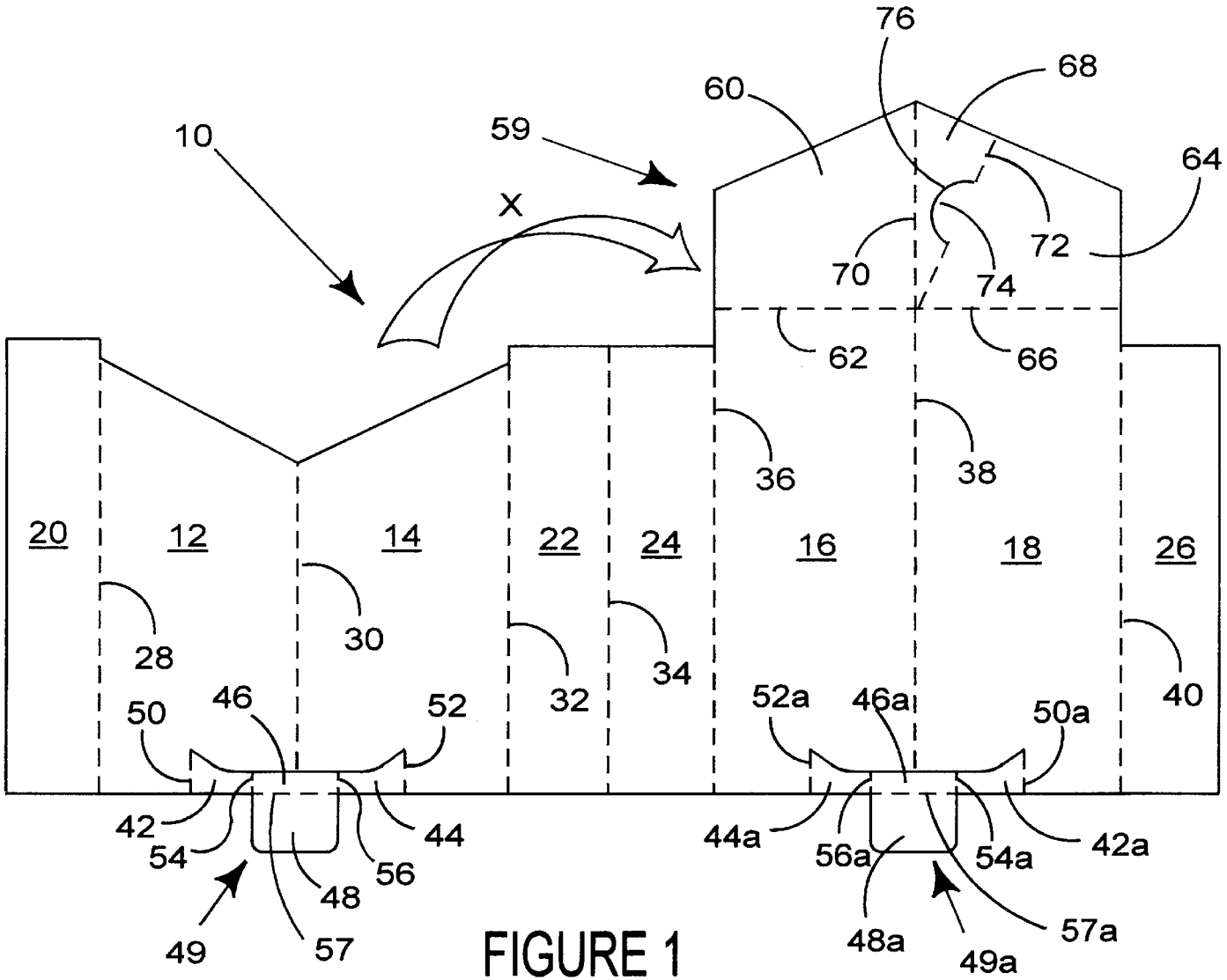
FIG. 1 is a plan view of a blank for forming an article cushion member according to the first embodiment of the invention.

Referring to the drawings and in particular FIG. 1 there is shown a blank 10 for forming a cushion member or receptacle made from paperboard or other like foldably sheet material. The cushion member is adapted to be placed in an outer carton. In this embodiment, the blank 10 comprises a plurality of side wall panels including a first side wall panel 12, a second side wall panel 14 hingedly connected together along fold line 30. There further comprises third side wall panel 16 and fourth side wall panel 18 hingedly connected together along fold line 38. The side wall panels 12, 14, 16, 18 are connected together to form a collapsible upright tubular structure for receiving an article.

Preferably, there further comprises stabilizing means hingedly connected to the panels forming the tubular structure, which stabilizing means is adapted for frictional engagement with the inside surface of an outer carton, described below. In this embodiment, stabilizing means is provided by support panels 20, 22 and 24, 26, which are adapted to protrude outwardly beyond one or more corners of the tubular structure.

Thus, it can be seen from FIG. 1 that support panel 20 is hingedly connected to first side wall panel 12 along fold line 28. Support panels 22 and 24 are hingedly connected to second side wall panel 14 and third side wall panel 16 along fold lines 32 and 36 respectively. In this embodiment, support panels 22 and 24 are hingedly connected together along a common side edge by fold line 34. Support panel 26 is hingedly connected to fourth side wall panel 18 along fold line 40.

Another aspect of the invention is provided by article support structure 51 (FIG. 4), which comprises a plurality of displaceable strips 49, 49*a* secured together. In the embodiment shown in FIG. 1, the first displaceable strip 49 is provided by two outer parts 42, 44 sandwiching central part 46 hingedly connected together in series along fold lines 54 and 56. Similarly, the second displaceable strip 49*a* is provided by two outer parts 42*a*, 44*a* sandwiching central part 46*a* hingedly connected in series along fold lines 54*a*, 56*a*. Preferably, the first displaceable strip 49 is hingedly connected to the first and second side wall panels 12, 14 along fold lines 50 and 52 thereby to bisect fold line 30. The second displaceable strip 49*a* is hingedly connected to the third and fourth side wall panels 16, 18 along fold lines 52*a* and 50*a* thereby to bisect fold line 38. In one class of embodiments, there further comprises a glue flap 48, 48*a* hingedly connected to at least one of the displaceable strips 49, 49*a* along fold line 57, 57*a*.

Optionally, there further comprises a top protection structure 59 for supporting an upper portion of an article contained within the cushion member. In this embodiment, the top protection structure 59 comprises first and second upper panels 60 and 64 that are hingedly connected to third and fourth side wall panels 16 and 18 along fold lines 62 and 66 respectively. There further comprises gusset panel 68 intermediate upper panels 60 and 64 hingedly connected thereto along fold lines 70 and 72. The fold lines 70 and 72 are arranged such that the gusset panel is, preferably, triangular in shape and is adapted to be folded into face contacting relationship with panels 60 and 64, described below. There may further comprise a glue tab 74 struck from the gusset panel 68 and connected to one of the upper panels 64, which glue tab extends into gusset panel 68 and is separated therefrom by cut line 76. In this embodiment, the glue tab 74 is substantially semicircular in shape.

Figure 2:
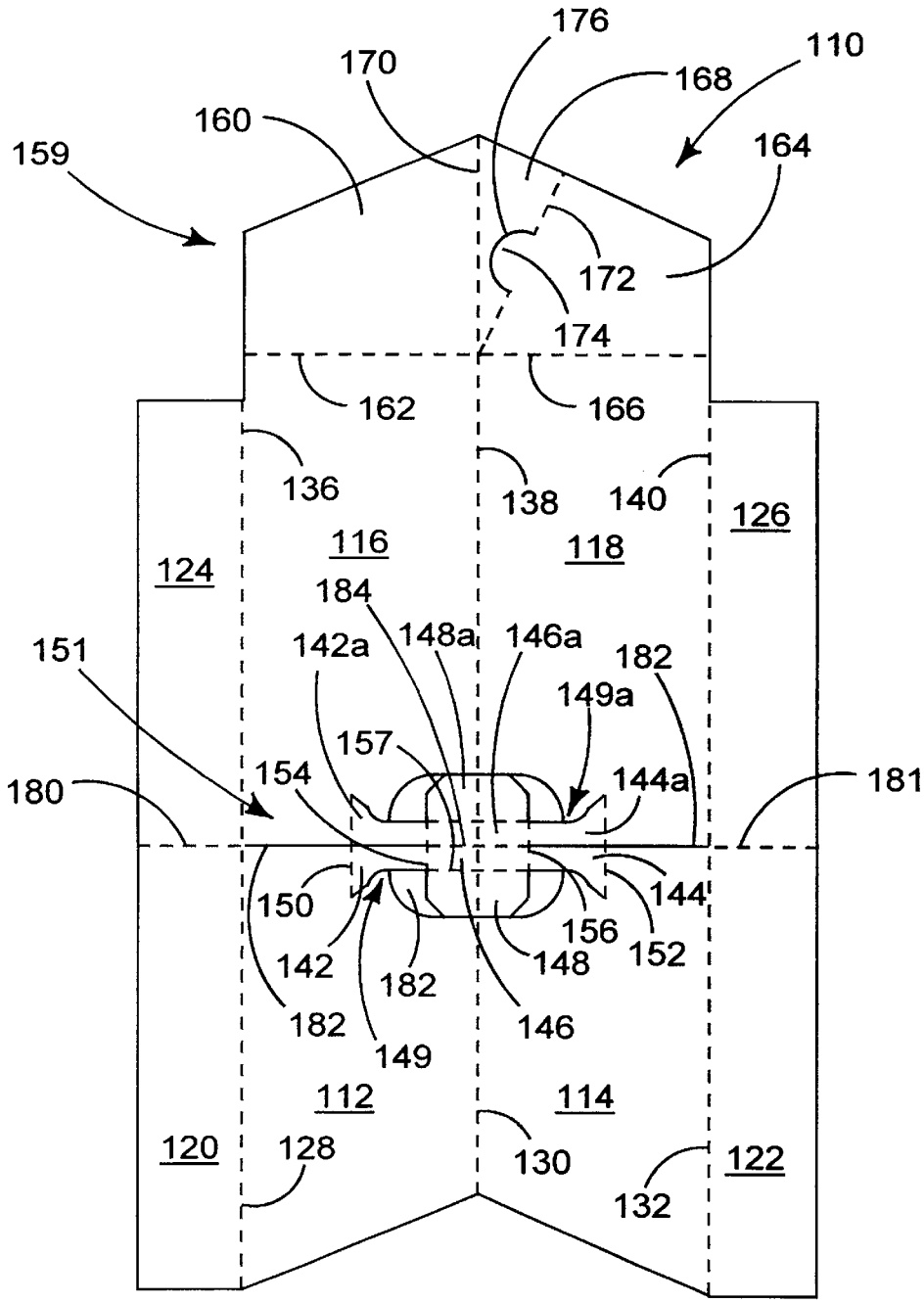
FIG. 2 is a plan view of a blank for forming an article cushion member of a second embodiment.

A second embodiment of cushion member is illustrated in FIG. 2 which shows a blank formed from paperboard or similar foldable sheet material. In this embodiment, the cushion member is provided with a top protection structure 159, stabilizing means and article support structure 151 formed from panels similar to those described in the first embodiment and therefore like parts are designated by the same reference numeral with the prefix "1" and are not therefore described in any greater detail. Only the differences between the first and second embodiments shall be described below.

It will be seen that the first support panel 120, first and second side wall panels 112 and 114 and second support panel 122 are hingedly connected together in series along fold lines 128, 130 and 132 respectively to form one side of the tubular structure. Likewise, support panel 124, third and fourth side wall panels 116, 118 and support panel 126 are hingedly connected together in series along fold lines 136, 138 and 140 to form the other side of the cushion member. These panels forming each side of the tubular carton are hingedly connected along their respective lower edges. In this embodiment, the hinged connection is along co-linear fold lines 180 and 181 extending across support panels 120/124, 122/126 only. Thus first and second side wall panels 112, 114 are separated from third and fourth side wall panels 116, 118 by cut line 182 which is aligned with and extends between fold lines 180 and 181. Cut line 182 extends into the article support structure 151 to separate the opposing outer parts 142, 142*a* and 144, 144*a* of the displaceable strips 149, 149*a*. The central displaceable strips 146 and 146*a* are hingedly connected together along fold line 184. It will be seen from FIG. 2 that fold line 184 interrupts cut line 182.

There may further comprise a platform for holding the article. In this embodiment, the platform is provided by one or more foldable flaps 148 and 148*a* hingedly connected to the upper edge of the central parts 146, 146*a* of the displaceable strips.

Figure 8:
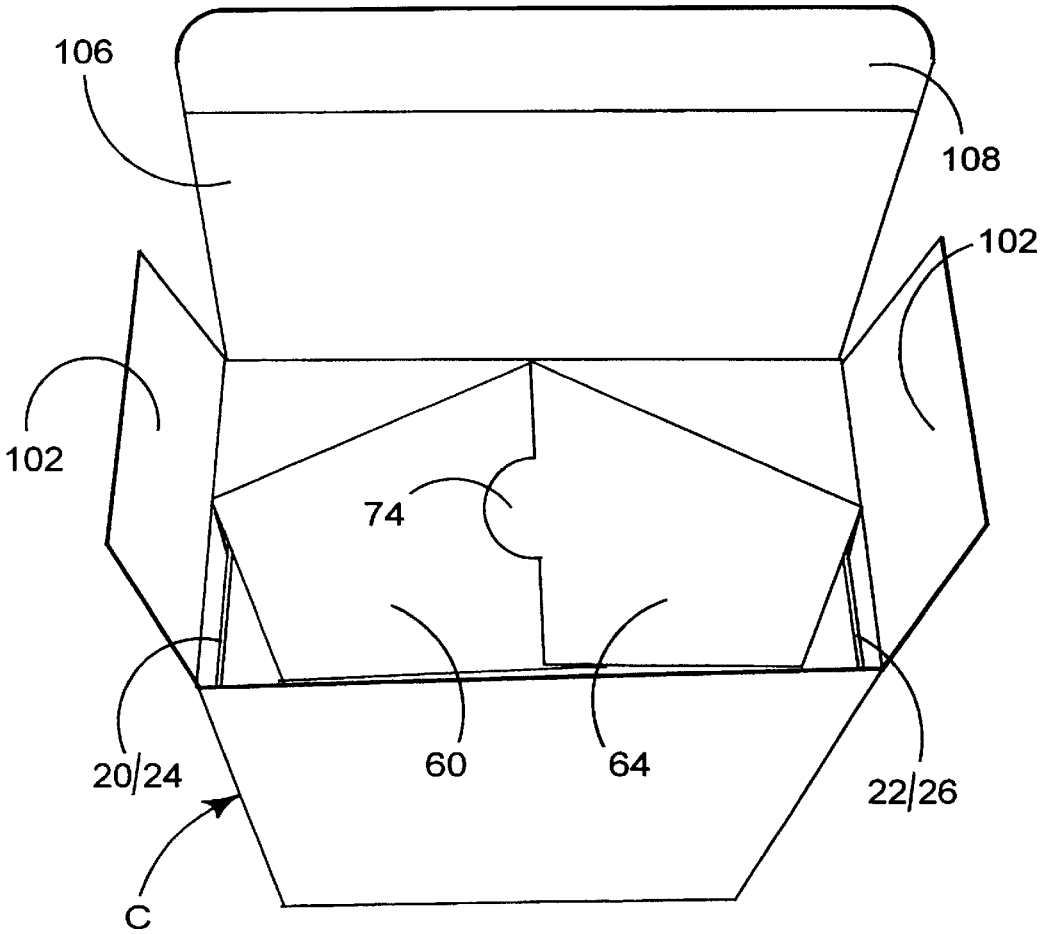
FIG. 8 is a perspective view from above illustrating the top protection structure according to another aspect of the invention.

The first and second embodiments illustrated in FIGS. 1 and 2 are adapted to be placed within an outer carton C, an example of which is illustrated in FIG. 8. However, it is envisaged that the article support structure 51, 151 and top protection structure 59, 159 could be applied to other types of carton or article carrier, for example wraparound or basket carriers where it is provided to support and/or protect an article.

Figure 3:
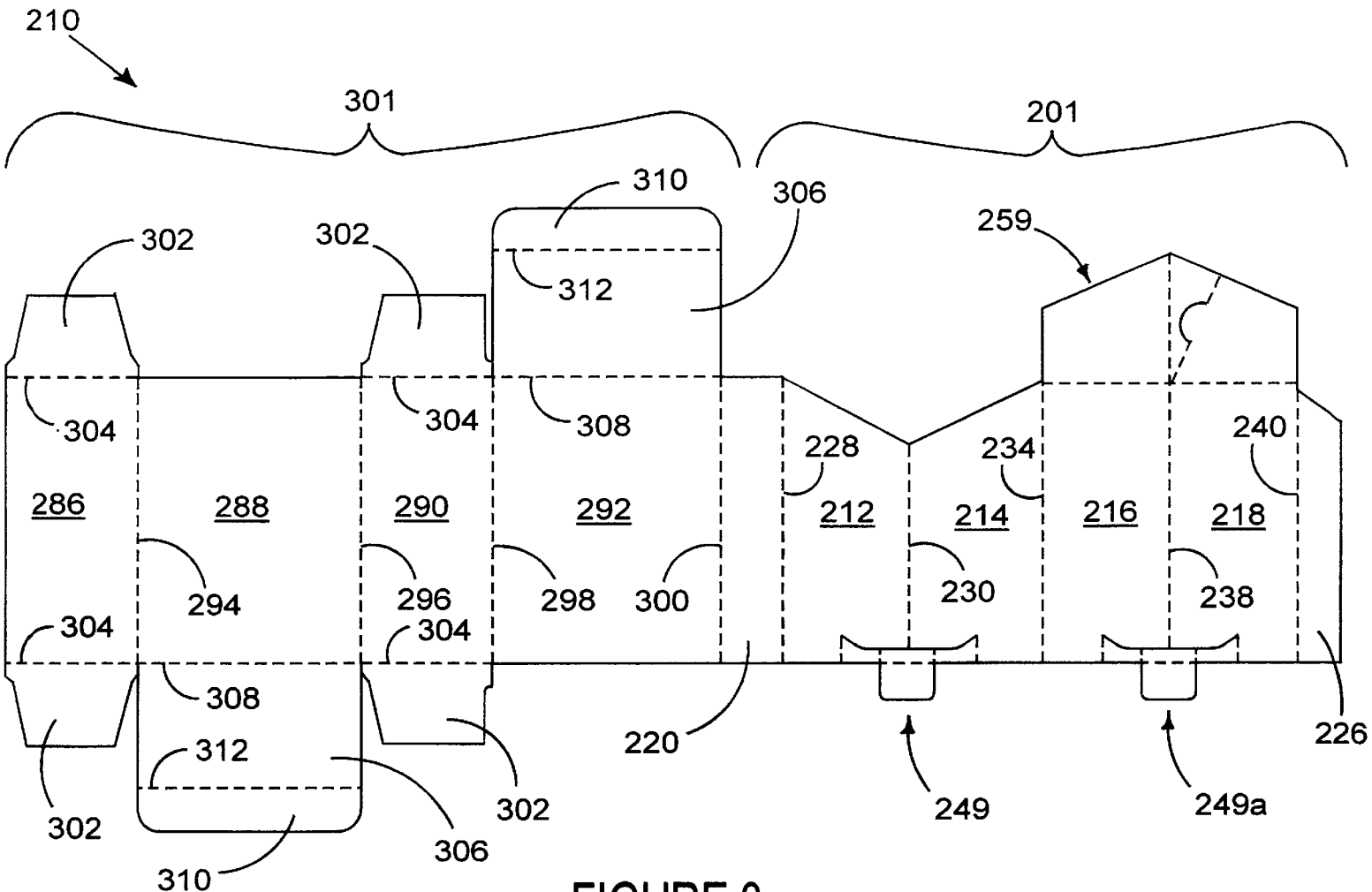
FIG. 3 is a plan view of a blank for forming an article cushion member and outer carton according to a third embodiment.

Turning to the third embodiment illustrated in FIG. 3 there is shown a blank 210 in which the cushion member 201 and outer carton 301 are formed from a unitary blank of paperboard of similar foldable sheet material. The cushion member 201 is similar to the first embodiment and like reference numerals are used to designate common features prefixed with the numeral "2".

It will be seen that there comprises first, second, third and fourth side wall panels 212, 214, 216, 218 hingedly connected together in series along fold lines 230, 234 and 238. Article support means formed from displaceable strips 249 and 249*a* are struck from the first and second side wall panels 212, 214 and third and fourth side wall panels 216, 218 respectively. The displaceable strips 249, 249*a* correspond to the strips 49, 49*a* of the first embodiment. Preferably, there further comprises a top protection structure 259 substantially the same as structure 59 described above.

In this embodiment, the stabilizing means is provided at one edge of the tubular structure and is formed by panel 220 hingedly connected to the first side wall panel 212 along fold line 228. A glue flap 226 is hingedly connected to the fourth side wall panel 218 along fold line 240 to be glued to the first side wall panel 212.

The outer carton 301 is constructed from first end panel 286, front panel 288, second end wall panel 290 and rear panel 292 hingedly connected together one to the next along fold lines 294, 296, 298 respectively. Preferably, there further comprises support flaps 302 hingedly connected to upper and lower edges of the end wall panels 286 and 290 along fold lines 304. There further comprises top and bottom wall panels 306 and securing flaps 310 hingedly connected along fold lines 312 to the top and bottom wall panels which in turn are connected to front and rear panels 288, 292 respectively along fold lines 308.

The cushion member is hingedly connected to a side edge of one of the panels forming the outer carton. In this embodiment, the cushion member 201 is hingedly connected to rear panel 292 along fold line 300.

The cushion member of the first, second and third embodiments is not limited to a rectangular or diamond tubular shape and could comprise other panels to define other polygonal shapes and sizes, depending upon the article to be contained within the cushion member.

It is envisaged that the cushion member and/or article carrier of the present invention can be formed by a series of sequential folding and gluing operations which can be formed in a straight-line machine so that the carton is not required to be rotated or inverted to complete its construction. The folding process is not limited to that described below and can be altered according to particular manufacturing requirements.

Figure 4:
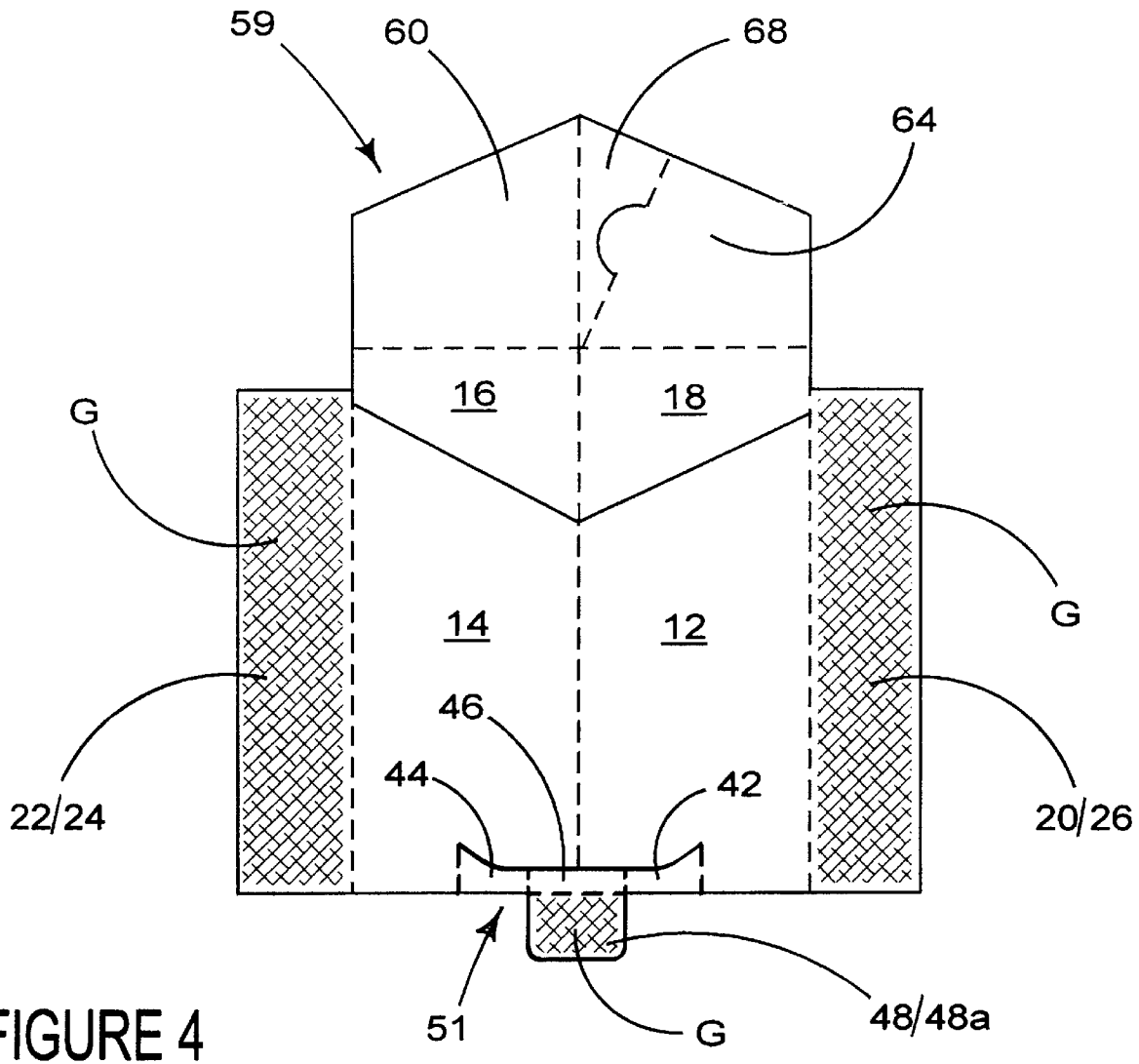
FIG. 4 is a perspective view of the cushion member of the first embodiment partially formed and in a flat collapsed condition.

Turning to the first embodiment shown in FIG. 1, in order to set up the cushion member into a position of use, side wall panels 12, 14 and support panels 20 and 22 are folded about fold line 34 in direction X (FIG. 1) into face contacting relationship with corresponding support panels 24 and 26 and side panels 16 and 18 respectively, as shown in FIG. 4. Optionally, the support panels 22, 24 and 20, 26 are secured together by glue or other suitable means known in the art. In this embodiment, glue is applied to part or all of the section G.

Figure 7:
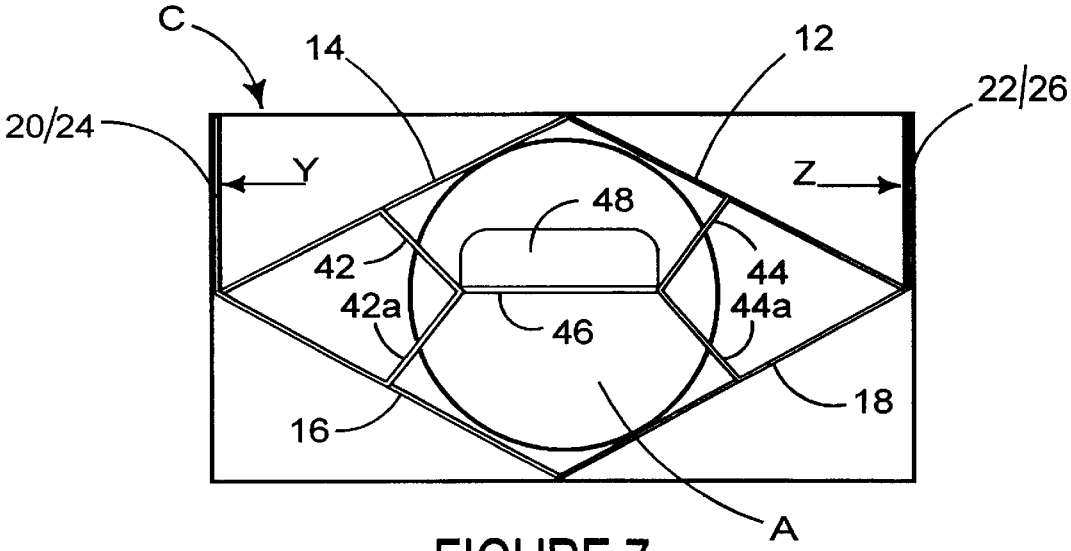
FIG. 7 is a bottom plan view of the article support means and outer carton shown in FIG. 6.

In order to form the article support structure 51 shown in FIG. 7, the central part 46 and 46*a* of the displaceable strip may be secured together. In those embodiments with glue flaps, the glue flaps 48, 48*a* are secured together by glue designated by letter G or other suitable means known in the art. FIG. 4 shows the carton in a flat collapsed condition ready to be placed in a set up condition to receive the article.

In order to put the cushion member 10 into a position of use, side panels 12 and 14 are folded out of alignment along fold line 30 and likewise third and fourth side wall panels 16 and 18 are folded out of alignment along fold line 38. This folding action causes support panels 20/26 and 22/24 to be folded out of alignment with the adjacent side wall panel along fold lines 28/40 and 32/36.

Figure 5:
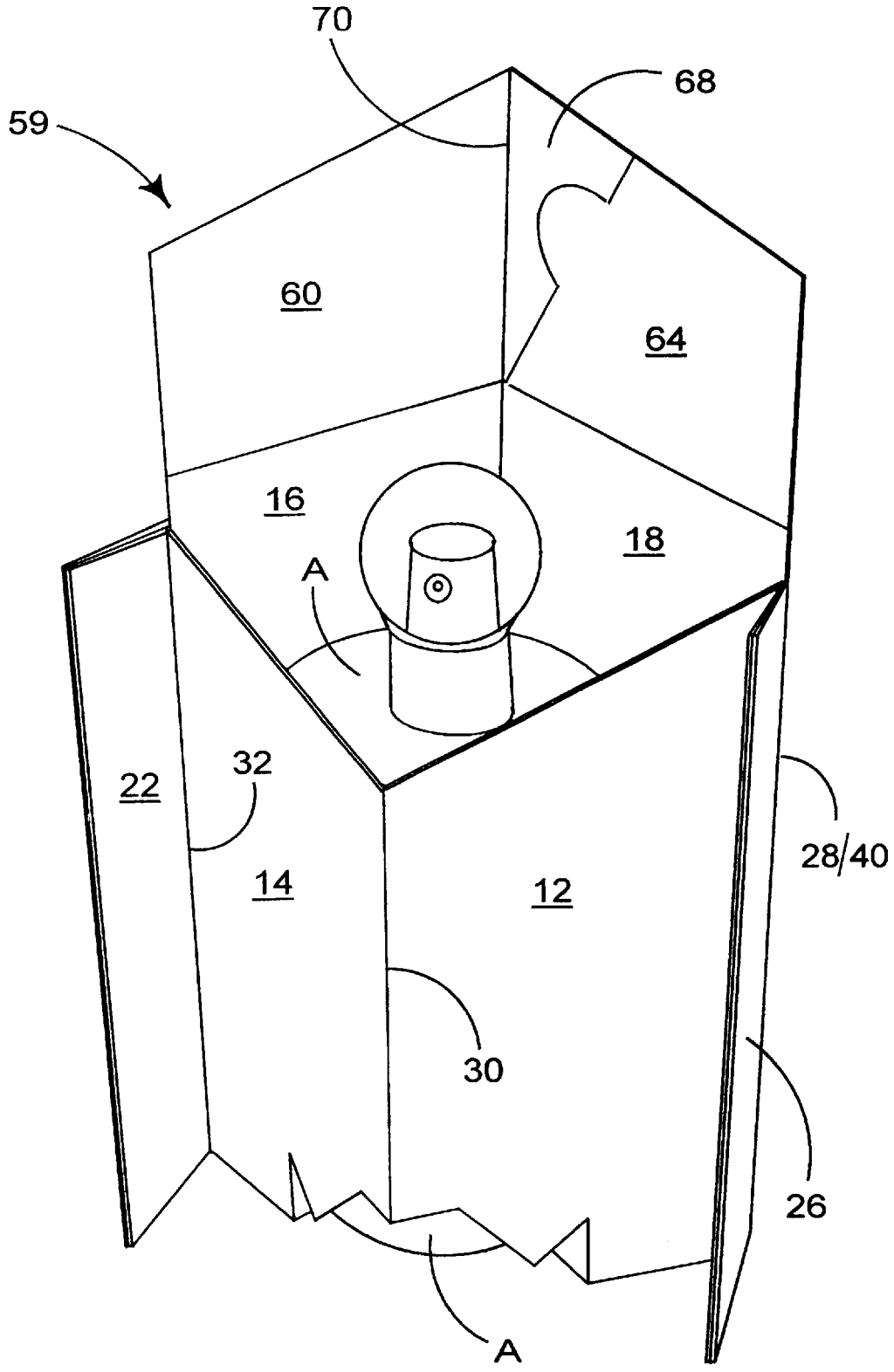
FIG. 5 is a perspective view of the first embodiment set up and loaded with an article.

By folding the side wall panels in an outward direction, an open ended tubular structure is formed, as shown in FIG. 5. In this embodiment the structure is diamond shaped although it is envisaged that the carton could be rectangular, trapezoidal, square or another polygonal form.

As the tubular structure is constructed, the support structure 51 is automatically displaced into the tubular structure whereby the outer parts 42, 42*a*, 44, 44*a* of the displaceable strips are folded along fold lines 50, 50*a* and 52, 52*a* in an inward direction, shown in FIG. 7, such that the central parts 46, 46*a* of the displaceable strips remain within a central region of the tubular structure. Thereafter, glue flaps 48 and 48*a* can be folded along their upper edges into a substantially perpendicular relationship with the respective central parts 46, 46*a* (not shown) of the displaceable strips 49, 49*a*. In use, the glue flaps 48,48*a* may be adapted to frictionally engage the base wall of the outer carton, thereby to provide additional stability to the article support structure 51 and in some embodiments is secured thereto by glue or other suitable known means. Thereafter, the article is loaded by relative vertical movement between the article and cushion member. The cushion member and article is loaded into an outer carton C.

Figure 6:
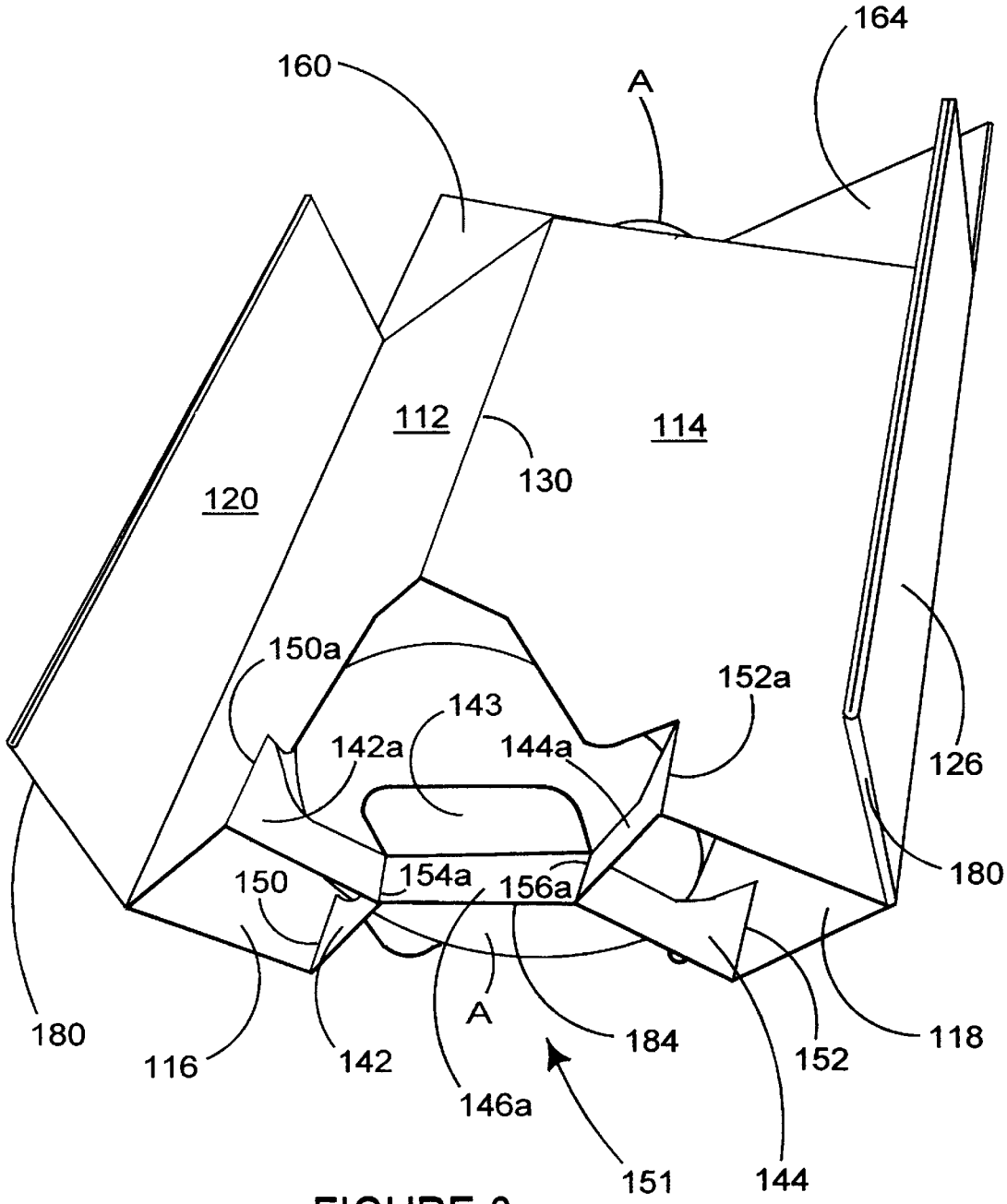
FIG. 6 is a perspective view from the underside showing the article support means according to one aspect of the invention.

The second embodiment shown in FIG. 2 is constructed in a like manner by reference to FIGS. 2 and 6 whereby support panels 120 and 122 and first and second side panels 112 and 114 are folded about fold line 180, 181 and 184 into face contacting relationship with the respective side wall support panels 124, 126 and third and fourth side wall panels 116 and 118. Optionally, support panels 120, 124 and 122, 126 are secured together by glue or other suitable means known in the art. Construction of the article support structure 151 is substantially the same as for the first embodiment described above and shown in FIG. 6. It is not therefore described in any greater detail.

In those embodiments with a platform structure 143 shown in FIG. 6, the flaps 148, 148*a* forming the platform structure may be secured together by glue or other suitable means known in the art to provide a double ply platform. In order to construct and load the tubular structure of the second embodiment the same folding procedure is carried out as that described above for the first embodiment, so that the platform structure 143 is folded into a substantially horizontal arrangement shown in FIG. 6 thereby to provide a platform on which the article rests. Alternatively, the flaps 148, 148*a* may remain unglued and may be folded away from each other to take the respective horizontal positions. In this option, the central parts 146, 146*a* of the displaceable strips 149, 149*a* may be glued together.

In those embodiments with stabilizing means, the support or stabilizing panels 20, 26 and 24, 28 are folded along their common side edges with the tubular structure, such that the support panels are in a substantially parallel arrangement, so that the cushion member can be inserted into the carton, for example a rectangular carton. The nature of the paperboard or like material is resilient such that the stabilizing panels 22/24 and 20/26 will tend to return to its original orientation with respect to the tubular structure in directions Y and Z (FIG. 7) and thus when inserting the carton will frictionally engage the inside surface of the outer carton, shown in FIGS. 7 and 8.

In those cartons with top protecting structure 59, it is constructed by folding upper panels 60 and 64 out of alignment along fold line 70 to allow the tubular structure to be formed as shown in FIG. 5. In order to close the top protection structure 59, gusset panel 68 is folded along fold lines 70 and 72 to be placed in overlapping face contacting relationship with the upper surface of panel 60 and thereafter the glue tab 74 is secured to the upper surface of panel 60 by glue or other suitable means known in the art. The completed top protection structure is shown in FIG. 8 and the top 106 and end flaps 102 of the outer carton C are folded over and secured in a closed form as is well known.

The third embodiment shown in FIG. 3 is formed whereby the cushion member 201 is constructed first in a similar manner to the first embodiment described above whereby first and second side wall panels 212 and 214 are placed in face contacting relationship with third and fourth side wall panels 216, 218 and the glue flaps and/or central parts of the displaceable strips 249, 249*a* of the support structure are glued together as described above. The glue flap 226 is folded along the fold line 240 and glued to the inside surface of the first side wall panel 212. Thereafter, the panels forming the outer carton are folded about the cushion member in a wraparound fashion whereby panels 290, 292 are folded about fold line 300 into face contacting relationship with side panels 216 and 218 of the cushion member and panels 286 and 288 are folded about fold line 296 to come into face contacting relationship with the opposing side wall panels 212, 214 of the cushion member and is secured together by gluing end panel 286 to support panel 220 thereby to form the carton in a flat collapsed condition.

In order to construct the tubular structure and carton C, the end panels 286, 290 and the front and rear panels 288, 292 are separated to form a tubular structure which causes the cushion member side walls 212, 214 and 216, 218 to be separated. The support structure 249, 249*a* is automatically deployed in the manner described above so that an article A can be placed within the cushion member. Thereafter the top protection structure 259 is formed as described above and the base and top panels of the carton can be closed as is well known in the art. Thus, there is provided a carton C substantially similar to that illustrated in FIG. 8.

It is envisaged that the support structure 51; 151; 249, 249*a* of the invention can be automatically erected so as to act as a strut by employing configurations other than those described above, without departing from the scope of invention. For example, the support structure 51 need not be centrally positioned. The support structure strengthens the overall carton structure and assists in maintaining a tubular structure when for example the carton is stored on a supermarket shelf. The platform 48, 143 provides further support for the article contained within it.

Furthermore the support structure can be adapted so that the panels will tend to crumple for example in a vertical plane in the event of excessive or sudden movement of the article within the carton for example during transit, thereby to dissipate the forces, and reduce the risk the article will be damaged.

It will be recognized that as used herein, directional references such as "top", "base", "end", "side", "upper" and "lower" do not limit the respective panels to such orientation, but merely serve to distinguish these panels from one another. Any reference to hinged connection should not be construed as necessarily referring to a single fold line only: indeed it is envisaged that hinged connection can be formed from one or more of one of the following, a score line, a frangible line or a fold line, without departing from the scope of invention.

The present invention and it preferred embodiments relate to a carton and/or cushion member which is shaped to provide satisfactory rigidity to hold fragile items such as bottles securely but with a degree of flexibility. The shape of the blank minimizes the amount of paperboard required for the carton. The carton can be constructed from a flat collapsed condition to a position of use by hand or automatic machinery. Furthermore, the base configured to act as a strut can be replaced by a strut formed from other panels of the carton and/or can include one or more struts without departing from the scope of invention.

What is claimed is:

1. A receptacle for packaging one or more articles comprising a collapsible upright tubular structure for receiving an article and an article support structure at a lower end of said tubular structure for supporting the article, wherein said support structure comprises a plurality of displaceable strips secured together such that when said tubular structure is erected from a flat collapsed form, said displaceable strips are automatically displaced into said tubular structure to form said support structure, and wherein at least one of said displaceable strips is provided along an upper edge thereof with a foldable flap for providing a platform for the article.

2. The receptacle as claimed in claim 1 wherein said tubular structure comprises two pairs of mutually hinged side wall panels, each pair having a respective one of said displaceable strips wherein said displaceable strips are interconnected.

3. The receptacle as claimed in claim 2 wherein said displaceable strips are partially connected along a common lower edge.

4. The receptacle as claimed in claim 2 wherein a portion of said displaceable strips are in face contacting relationship.

5. The receptacle as claimed in claim 4 wherein said support structure further comprises a pair of glue flaps to secure part of said displaceable strips together.

6. An article carrier comprising an outer carton and a cushion member, wherein said outer carton has four side walls, said cushion member has four side wall panels hinged together to form a collapsible upright tubular structure of a diamond-shaped cross section having four corners and stabilizing means hingedly connected to said tubular structure for frictional engagement with inside surface of said outer carton, each of said four side wall panels of said cushion member extends between adjacent side walls of said outer carton so that said four corners of said tubular structure are in abutment on said four side walls of said outer carton respectively, said stabilizing means comprises a pair of friction wings foldably connected respectively to two diametrically opposed ones of said four corners of said tubular structure, and said friction wines are folded out of alignment with said four side wail panels of said cushion member so as to be disposed respectively along inside surfaces of adjacent ones of said four side wails of said outer carton.

7. The article carrier as claimed in claim 6 wherein each of said friction wings comprises a pair of end panels secured together, said end panels of said each friction wing being hingedly connected respectively to two adjacent ones of said four side wall panels of said cushion member and being folded with respect to said adjacent side wall panels of said cushion member to be flat with said inside surfaces of said adjacent side wall of said outer carton.

8. A blank for forming a cushion member for placement into an outer carton, said cushion member comprising a collapsible upright tubular structure for receiving an article, stabilizing means hingedly connected to said tubular structure for frictional engagement with inside surface of the outer carton, and an article support structure at a lower end of said tubular structure for supporting the article, said blank comprising a first series of panels and a second series of panels, each series including a pair of opposite end panels forming said stabilizing means and medial panels for forming said tubular structure, said medial panels of said each series having a displaceable strip for forming said support structure, wherein said first and second series are hingedly connected together along a common lower edge of said pairs of said opposite end panels and wherein said displaceable strips are hingedly connected together by a fold line extending alone a common edge of said displaceable strips, said common edge extending along the length of said displaceable strips.

9. A blank for forming a receptacle for receiving one or more articles, said receptacle comprising a collapsible upright tubular structure and an article support structure at an lower end of said tubular structure, wherein said blank comprises two pairs of mutually hinged side wall panels for forming said tubular structure, each pair of said side wall panels having a respective displaceable strip for forming said support structure, and wherein at least one of said displaceable strips is provided along an upper edge thereof with a foldable flap for providing a platform for supporting an article in a set up condition.

10. The blank as claimed in claim 9 wherein said displaceable strips are partially connected along a common lower edge.

11. The blank as claimed in claim 9 wherein said displaceable strips comprise a pair of glue flaps for securing said displaceable strips together in a set up condition.

12. A receptacle for receiving one or more articles, said receptacle comprising a collapsible upright tubular structure for receiving an article, and an article support structure at a lower end of said tubular structure for supporting the article, said tubular structure comprising two pairs of mutually hinged side wall panels, each of said two pairs having a displaceable strip for forming said support structure, said displaceable strip of said each pair being formed from said side wall panels of said each pair, and wherein said displaceable strips of said pairs are hingedly connected together by a fold line extending along a common lower edge of said displaceable strips.

13. The receptacle as claimed in claim 12 further comprising stabilizing means hingedly connected to said tubular structure for frictional engagement with inside surface of an outer separate receptacle, said stabilizing means comprising a pair of opposite end panels hingedly connected respectively to said side wall panels of said each pair, wherein said pairs of said opposite end panels are hingedly connected together along a common lower edge of said pairs of said opposite end panels.

14. A blank for forming a receptacle for receiving one or more articles, said receptacle comprising a collapsible upright tubular structure for receiving an article, and an article support structure at a lower end of said tubular structure for supporting the article, said blank comprising a first series of panels and a second series of panels, each series including a pair of mutually hinged side wall panels for forming said tubular structure, said side wall panels of said each series having a displaceable strip for forming said support structure, said displaceable strip of said each series being formed from said side wall panels of said each series, and wherein said first and second series are hingedly connected together by a fold line extending along a common edge of said displaceable strips, said common edge extending along the length of said displaceable strip.

15. A receptacle for packaging one or more articles comprising a collapsible upright tubular structure for receiving an article and an article support structure at a lower end of said tubular structure for supporting the article, said tubular structure comprising two pairs of mutually hinged side wall panels, said support structure comprising a pair of displaceable strips formed respectively from said pairs of said side wall panels, each of said displaceable strips including a pair of outer parts sandwiching a central part hingedly connected together in series, said central parts of said displaceable strips are secured together such that when said tubular structure is erected from a flat collapsed form, said displaceable strips are automatically displaced into said tubular structure to form said support structure.

* * * * *